US009631796B2

(12) United States Patent
Ma et al.

(10) Patent No.: US 9,631,796 B2
(45) Date of Patent: Apr. 25, 2017

(54) ILLUMINATION UNIT FOR MEDICAL USE AND ILLUMINATION DEVICE FOR MEDICAL USE

(71) Applicant: OSRAM GmbH, Munich (DE)

(72) Inventors: Ai Ma, Foshan Guangdong (CN); Xuguang Cao, Kunshan Jiangsu (CN); Jun Liu, Kunshan Jiangsu (CN)

(73) Assignee: OSRAM GMBH, Munich (DE)

( * ) Notice: Subject to any disclaimer, the term of this patent is extended or adjusted under 35 U.S.C. 154(b) by 177 days.

(21) Appl. No.: 14/548,330

(22) Filed: Nov. 20, 2014

(65) Prior Publication Data

US 2015/0153027 A1 Jun. 4, 2015

(30) Foreign Application Priority Data

Dec. 3, 2013 (CN) ..... 2013 2 0787697 U

(51) Int. Cl.

| | |
|---|---|
| ***F21V 17/04*** | (2006.01) |
| ***F21V 7/00*** | (2006.01) |
| ***F21V 19/00*** | (2006.01) |
| *F21V 19/04* | (2006.01) |
| *F21W 131/20* | (2006.01) |
| *F21Y 113/00* | (2016.01) |
| *F21Y 101/00* | (2016.01) |

(52) U.S. Cl.

CPC ..... *F21V 17/04* (2013.01); *F21V 7/00* (2013.01); *F21V 19/003* (2013.01); *F21V 19/04* (2013.01); *F21W 2131/20* (2013.01); *F21Y 2101/00* (2013.01); *F21Y 2113/00* (2013.01)

(58) Field of Classification Search

CPC ..... F21V 7/00; F21V 17/04; F21V 19/003; F21V 19/04; F21W 2131/20; F21Y 2101/02; F21Y 2113/00; F21Y 2101/00

See application file for complete search history.

(56) References Cited

U.S. PATENT DOCUMENTS 4,882,660 A * 11/1989 Liverance ..... F21S 48/1113 313/113
8,702,274 B2 * 4/2014 Breidenassel ..... F21V 17/12 362/249.01

* cited by examiner

*Primary Examiner* — Stephen F Husar
(74) *Attorney, Agent, or Firm* — Viering, Jentschura & Partner mbB

(57) ABSTRACT

Various embodiments may relate to an illumination unit for medical use and an illumination device for medical use, wherein the illumination unit includes a light source and a first reflecting structure, the light source has a connecting structure, and the light source is detachably installed on the first reflecting structure by means of the connecting structure. The illumination unit for medical use and the illumination device for medical use according to various embodiments provide a convenient and simple detachable installation structure between the light source and a reflecting structure, such that the installation and maintenance are simple, and the effect of adjusting the color temperature also can be achieved according to different selection of the light source.

13 Claims, 4 Drawing Sheets

ILLUMINATION UNIT FOR MEDICAL USE AND ILLUMINATION DEVICE FOR MEDICAL USE

CROSS-REFERENCE TO RELATED APPLICATION

This application claims priority to Chinese Patent Application Serial No. 201320787697.2, which was filed Dec. 3, 2013, and is incorporated herein by reference in its entirety.

TECHNICAL FIELD

Various embodiments relate generally to an illumination unit for medical use and an illumination device for medical use.

BACKGROUND

The LED technology used in a light source has the advantages such as high luminous intensity, long service lifetime, and high efficiency and energy saving, therefore, this technology is widely used and gradually replacing the conventional illumination modes. In the field of medical use, the LED technology also plays an active role, for instance, the LED technology is applied to modern surgical shadowless lamp, medical examination lamp and dentist lamp, and the LED illumination technology also provides to users sufficient illumination effects adapted to various medical circumstances while simplifying development and maintenance of these medical equipment. Some current in-service illumination devices for medical use are configured with LED as light source and corresponding reflecting structure and lens, while as the light source and the reflecting structure, or the light source and the lens are always configured integrally, such illumination device can only be adapted to one circumstance, and if the light source or the lens needs to be changed, the whole illumination device should be replaced, which not only limits the application circumstances of this medical illumination device, but also results in a high cost of development and maintenance of this illumination device for medical use.

SUMMARY

Various embodiments relate to an illumination unit for medical use and an illumination device for medical use, wherein the illumination unit includes a light source and a first reflecting structure, the light source has a connecting structure, and the light source is detachably installed on the first reflecting structure by means of the connecting structure. The illumination unit for medical use and the illumination device for medical use according to various embodiments provide a convenient and simple detachable installation structure between the light source and a reflecting structure, such that the installation and maintenance are simple, and the effect of adjusting the color temperature also can be achieved according to different selection of the light source.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
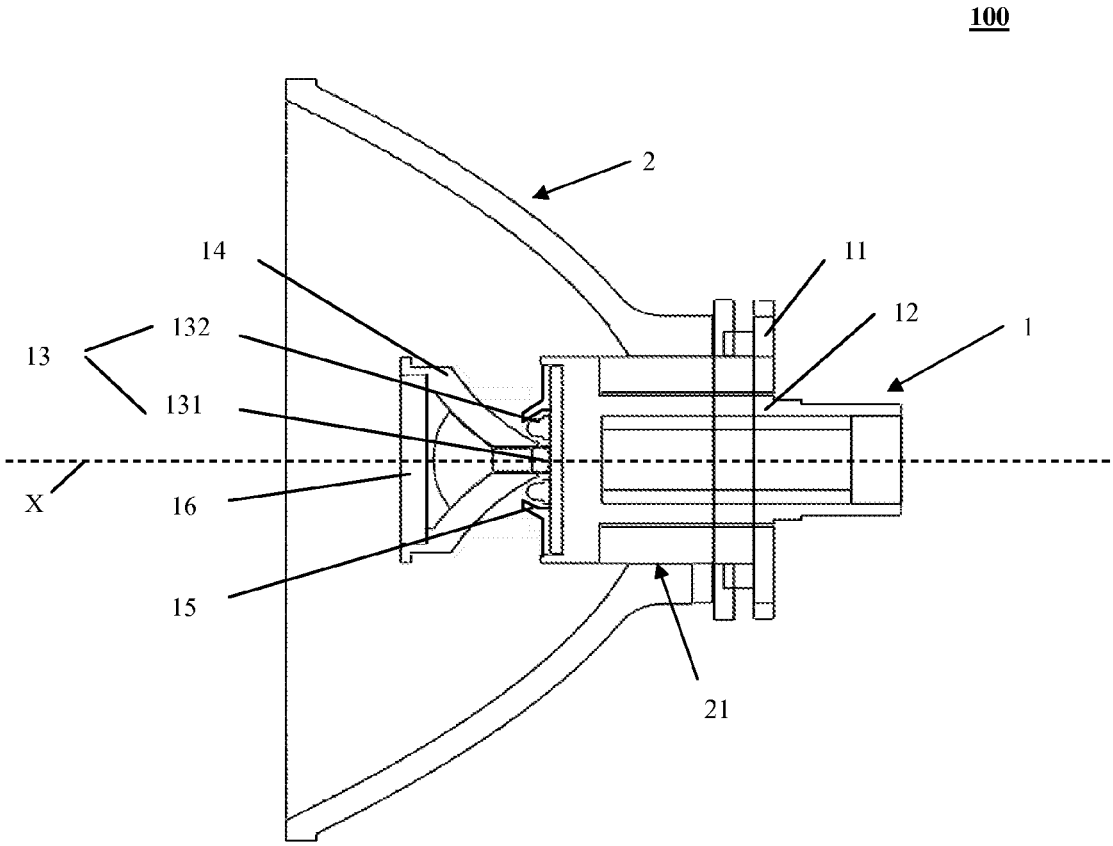
FIG. 1 shows a sectional diagram of an illumination unit according to a first embodiment of the present disclosure.

The following detailed description refers to the accompanying drawings that show, by way of illustration, specific details and embodiments in which the invention may be practiced.

Various embodiments provide an illumination unit for medical use and an illumination device for medical use, wherein this illumination unit has a simple and convenient detachable connecting structure, such that a light source of the illumination unit and a reflecting structure can be connected together in a detachable manner, and any combination thus can be made for adaptation to different application conditions; moreover, the illumination unit according to various embodiments further can achieve good medical illumination effect, and the illumination unit according to various embodiments provides quite simple installation and maintenance performances.

Various embodiments provide an illumination unit for medical use which includes a light source and a first reflecting structure, wherein the light source has a connecting structure, and the light source is detachably installed on the first reflecting structure by means of the connecting structure. The illumination unit for medical use implemented according to such configuration has the light source and the first reflecting structure detachably connected, and such illumination unit provides the possibility of replacing the light source according to different application circumstances, so that the object of adjusting the light source of the illumination unit can be achieved by removing and replacing the light source, and then the light source of the illumination unit is adjusted by installing the replaced light source to the original first reflecting structure, in this way, the illumination unit for medical use can be installed and maintained just by simple detachment.

It is provided, according to various embodiments, that the light source includes a heat dissipation structure, and the connecting structure is formed on the heat dissipation structure and is in one piece with the heat dissipation structure. While the heat dissipation structure provides a good heat dissipation function to the illumination unit, simple installation and securing of the light source can be achieved by installing and securing the light source on the first reflecting structure by means of the connecting structure integrated on the heat dissipation structure, moreover, it also provides the possibility of transferring the heat from the light source to the first reflecting structure, through the connecting structure, so as to dissipate heat highly effectively.

Further, the first reflecting structure has a plug-in opening, and the light source is fixedly connected with the first reflecting structure in a manner of being inserted into the plug-in opening. Through this plug-in opening, the light source can be vertically inserted into the first reflecting structure along a direction of an optical axis of the light source, and a simple and stable installation between the light source and the first reflecting structure is achieved with the aid of the connecting structure integrated on the heat dissipation structure, moreover, the space occupied by the illumination unit can be reduced by effectively using the space accommodated by the first reflecting structure.

In various embodiments, the illumination unit further includes a second reflecting structure and a shading structure, wherein at least part of light from a first part of light from the light source exits after being reflected by the second reflecting structure and a second part of light exiting from the light source is circumferentially blocked by the shading structure. With the second reflecting structure, at least part of light from the first part of light from the light source, after being reflected, arrive at the first reflecting structure, and exits after being reflected again by the first reflecting structure, to form a part of emergent light of the illumination unit. Moreover, the other part of light from the light source is blocked by the shading structure, and this part of light is prevented from interfering the reflected light in the first part of light, in this way, unfavorable effect of glaring of the illumination unit caused by lateral light from the light source can be prevented, and good medical illumination effect is provided.

In various embodiments, the illumination unit further includes a lens, and the light from the first part of light, which is not reflected by the second reflecting structure, exits directly through the lens. In virtue of the lens so configured, part of light in the first part of light from the light source, which is not reflected by the second reflecting structure, can directly exit without being reflected by the reflecting structure, and forms light exiting along the optical axis of the light source, so as to achieve a good light distribution applied in medical circumstances while ensuring a suitable light intensity of the illumination unit.

In various embodiments, the light source includes a plurality of light-emitting assemblies provided on the heat dissipation structure. The plurality of light-emitting assemblies form an effective plane light source so that effective rotationally symmetric emergent light is achieved after optical processing of the first and second reflecting structures or the lens.

In various embodiments, the second reflecting structure is rotationally symmetric, and viewed from a section through which the optical axis of the light source passes, the second reflecting structure has a reflective surface extending away from the direction of the optical axis. A part of light from the light source, after being reflected by the second reflecting structure, exits to a predetermined direction on a lateral direction of the second reflecting structure, and is reflected by the first reflecting structure, to finally form the emergent light of the illumination unit, thus, good light distribution can be formed according to predetermined emergent light. Besides, the second reflecting structure also may be configured in other forms, e.g. non-rotationally symmetric form, in complying with a shape of light distribution of emergent light to be achieved.

According to various embodiments, it is further proposed that the shading structure is configured in a sheet shape. The sheet-shaped shading structure may be configured in a continuous structure or segment structure, e.g. a sheet-shaped continuous structure in a ring form or a non-continuous segment-shaped structure in a petal form, so as to achieve that the light from the light source in different regions is blocked in different manners in a circumferential direction of the light source. The sheet-shaped shading structure can be simply installed on, e.g. the heat dissipation structure, while effectively saving the manufacturing material, and an effective use of the spatial volume of the illumination unit and good light-shading effect are achieved.

In various embodiments, the shading structure is configured to block the light source in the circumferential direction of the light source, and the shading structure extends in a manner of approaching the optical axis of the light source. According to such embodiment, the shading structure can circumferentially block light emitted from the light source at a certain angle so as to prevent this part of light from interfering the reflected light by the second reflecting structure, such that generation of glare of the illumination unit is avoided.

In various embodiments, the light-emitting assemblies include first light-emitting assemblies and second light-emitting assemblies, wherein the first light-emitting assemblies are provided in the center of the second reflecting structure, and the second light-emitting assemblies are arranged around the first light-emitting assemblies. Light from the first light-emitting assemblies exits directly after passing through the lens, and light from the second light-emitting assemblies exits after being reflected by the first reflecting structure and the second reflecting structure, respectively, wherein part of light from the second light-emitting assemblies are blocked by the shading structure.

In various embodiments, the shading structure extends in a manner of being parallel to the optical axis of the light source, and the light-emitting assemblies are separated from each other by the shading structure. Such shading structure can block light from the light-emitting assemblies, e.g. in a direction perpendicular to a surface where the light-emitting assemblies are installed.

In various embodiments, the illumination unit further includes a plurality of sub lenses each being provided over respective light-emitting assembly. The sub lens may be configured as a convex lens, and, for instance, to direct light from the light-emitting assembly, after the light converges, to the second reflecting structure, and the light, after being reflected by the second reflecting structure, to form light arriving at the first reflecting structure and finally form an emergent light of the illumination unit.

In various embodiments, the shading structure is formed by multiple intersected shading plates, wherein each two adjacent shading plates define a region for installation of at least one light-emitting assembly. According to such embodiment, the possibility of preventing light interference among various light-emitting assemblies can be achieved.

According to various embodiments, the light-emitting assemblies are configured as LEDs. The LED illumination technology has the advantages such as high efficiency, energy saving, and long service lifetime.

Various embodiments further provide an illumination device for medical use that includes the illumination unit as described above and a support, wherein the illumination unit is fixedly installed on the support by means of the connecting structure. The illumination device according to this embodiment can achieve good detachable installation, that is, simple installation and connection is present between the light source and the first reflecting structure, and between the illumination units, and simple installation and maintenance of the illumination device for medical use are achieved.

FIG. 1 shows a sectional diagram of an illumination unit 100 according to a first embodiment of the present disclosure. As shown in FIG. 1, the illumination unit 100 includes a light source 1 and a first reflecting structure 2, wherein the first reflecting structure 2 may be preferably a reflective cup or reflective bowl, and this illumination unit 100 is formed by installing and connecting the light source 1 and the first reflecting structure 2. It can be seen from FIG. 1 that the light source 1 includes a heat dissipation structure 12, on which a connecting structure 11 formed in one piece is provided, and it is achieved that the light source 1 is installed on the first reflecting structure 2 by means of connection between the connecting structure 11 and an opening at one end of the first reflecting structure 2, wherein this connecting structure 11 may be preferably a lock connecting structure, e.g. quarter-turn lock, threaded connecting structure, snap-on connecting structure, bolt connecting structure or other structures capable of achieving similar detachable connecting effect, so as to achieve that the light source 1 and the first reflecting structure 2, when engaging at the connecting structure 11, can be secured, connected and installed together. Moreover, to configure this connecting structure 11 to be detachable also aims at that only the connecting structure 11 needs to be removed and separated when it is desired to separate the light source 1 from the first reflecting structure 2 and to make subsequent change or maintenance.

It can be seen from FIG. 1 that the light source 1 is configured to further include a second reflecting structure 14, a lens 16 and light-emitting assemblies 13, and a shading structure 15, wherein the light-emitting assemblies 13 are preferably configured as LEDs. The light-emitting assemblies 13 are installed on the same plane so as to realize a light-emitting effect of a plane light source, and the light-emitting assemblies 13 are, for instance, divided into two types, i.e. first light-emitting assemblies 131 and second light-emitting assemblies 132, wherein the first light-emitting assemblies 131 are provided in the center of the second reflecting structure 14, and the second light-emitting assemblies 132 are provided around the first light-emitting assemblies 131 relative to the second reflecting structure 14, and are arranged in a ring form. Besides, the shading structure 15 is configured in a sheet shape, and also can be in a ring shape. The shading structure 15 surrounds the second light-emitting assemblies 132 circumferentially, and extends in a direction approaching an optical axis X of the light source 1 so as to block light emitted from the second light-emitting assemblies 132 at a certain angle. Moreover, light not blocked by the shading structure 15, after reflected by the second reflecting structure 14, is again reflected by the first reflecting structure 2 and emerges to form a part of emergent light of the illumination unit 100. Light emitted from the first light-emitting assemblies 131 emerges directly through the lens 16, and forms the other part of the emergent light of the illumination unit 100. In the above, the second reflecting structure preferably may be configured to be rotationally symmetric, and alternatively, it also can be configured in other forms, e.g. non-rotationally symmetric form, according to a shape of light distribution of emergent light to be achieved.

Figure 2:
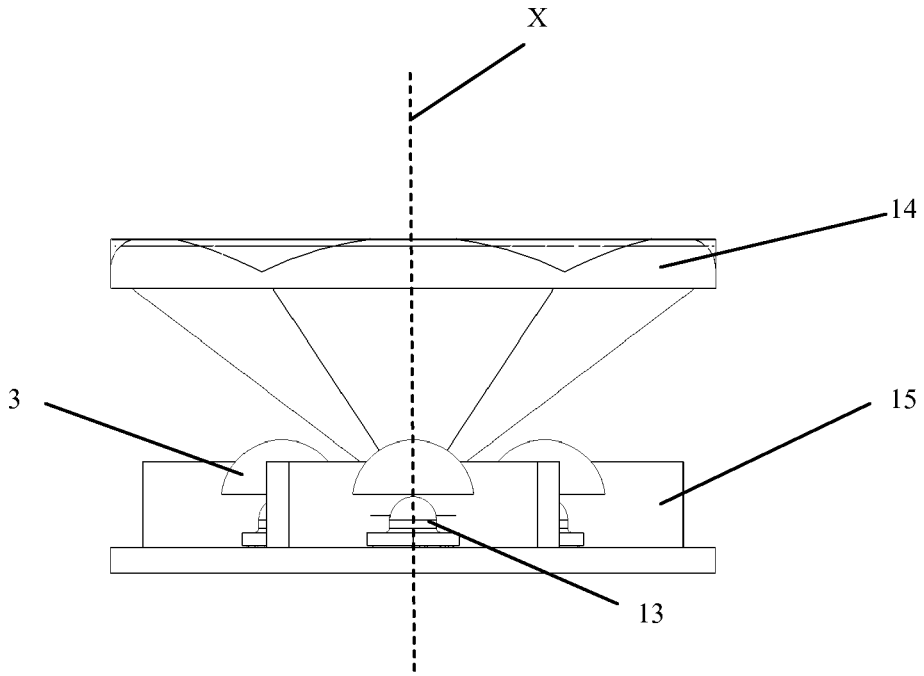
FIG. 2 shows a local diagram of the illumination unit according to a second embodiment of the present disclosure.

FIG. 2 shows a local diagram of the illumination unit 100 according to a second example of the present disclosure. According to the second example, the shading structure 15 also may be configured to extend parallel to the direction of the optical axis X of the light source 1, and can be configured with multiple intersected shading plates, so that two adjacent shading plates define a region for installation of at least one light-emitting assembly 13, thus, light from adjacent light-emitting assemblies 13 will not mutually interfere. In the second example, a sub lens 3 is further provided over each light-emitting assembly 13. Each sub lens 13 may be preferably configured as a convex lens, for instance, to converge and guide light from the light-emitting assembly 13 to a reflecting surface of the second reflecting structure 14, wherein it should be indicated that in this example, the light-emitting assemblies 13 may be provided in a central place of the second reflecting structure 14 according to need of configuration, in this way, light from the center and light from the light-emitting assemblies 13 in other places form the emergent light of the illumination unit 100. It should be indicated that in the second example, when the LED light source is provided, the lens 16 in the first example may be optionally provided on the second reflecting structure 14 according to an application condition, and it is also possible that there is no need to provide the lens 16 when no LED light source is present in the above-mentioned central place.

Figure 3A:
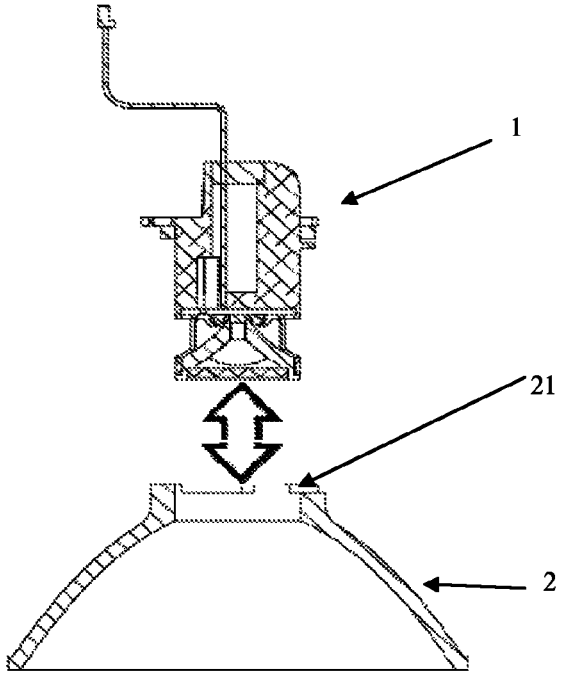
FIG. 3A and FIG. 3B show diagrams for installation of the illumination unit according to the present disclosure.
Figure 3B:
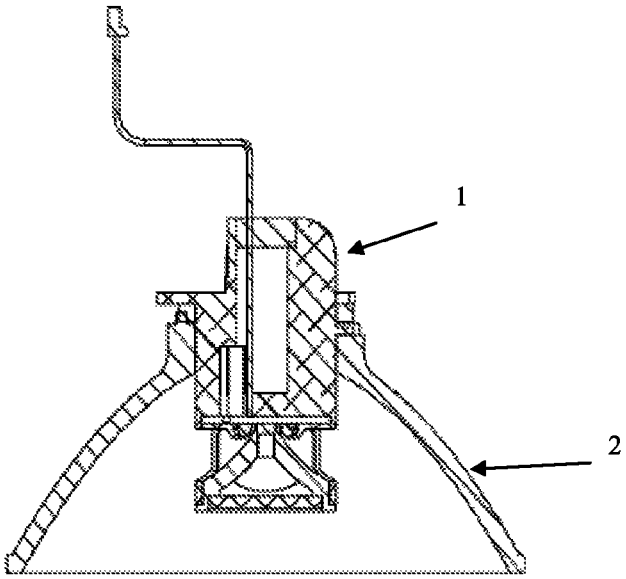

FIG. 3A and FIG. 3B show diagrams for installation of the illumination unit 100 according to the present disclosure. It can be seen from FIG. 3A and FIG. 3B that along the direction of the optical axis X of the light source 1, simple installation and securing between the light source 1 and the first reflecting structure 2 can be achieved just by inserting the light source 1 through a plug-in opening 21 of the first reflecting structure 2 from outside of the first reflecting structure 2, and fixedly connecting the connecting structure 11 of the light source 1 to this plug-in opening 21.

Figure 4:
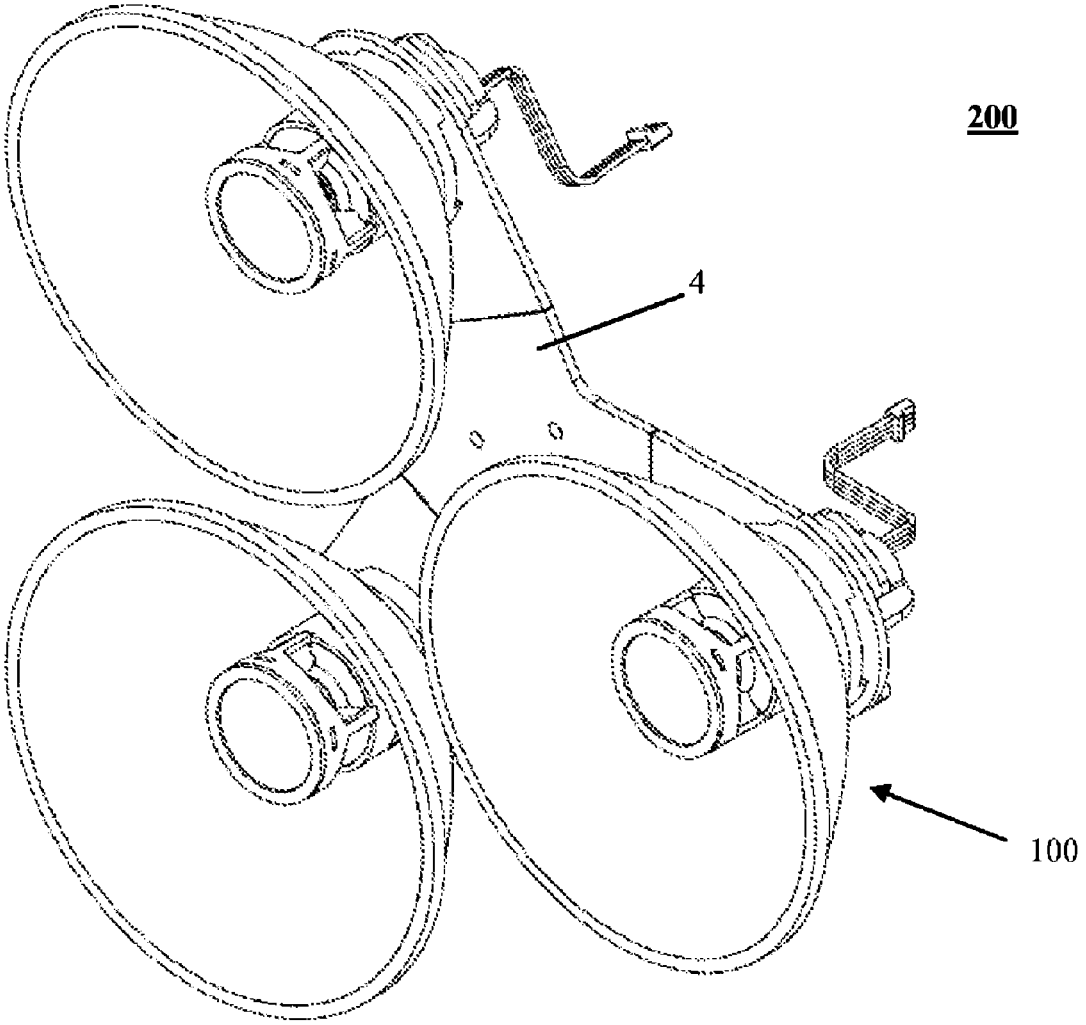
FIG. 4 shows a diagram of an illumination device according to the present disclosure.

FIG. 4 shows a schematic diagram of an illumination device 200 according to the present disclosure. The illumination device 200 not only includes the illumination unit 100 as shown in FIG. 1, FIG. 2, FIG. 3A to FIG. 3B, but also includes a support 4 as shown in FIG. 4. By means of the connecting structure 11 on the heat dissipation structure 12 of the light source 1, each illumination unit 100 may be installed and secured to the support 4, and each support 4 may be installed with multiple illumination units 100 so as to form the illumination device 200 with multiple illumination units 100. Such illumination device 200 may be configured with different numbers of the illumination units 100 according to different application circumstances, and the illumination units 100 may be arranged in different manners, such as in I-shaped, triangular or square or other similar arrangement, so as to realize illumination effect finally demanded. In the above, when the illumination device 200 is maintained, each illumination unit 100 may be removed from the support 4, and the light source 1 is removed from the illumination unit 100, such that the first reflecting structure 2 or the light source 1 may be arbitrarily changed, wherein the light-emitting assemblies 13, i.e. LED lamps, in the light source 1 also may be changed according to demands, so as to change effects such as color temperature of the light source 1, and after the change, various parts can be again installed together to re-form the illumination device 200.

The Illumination devices 100 and 200 can also be used for other lighting applications, for example in the Entertainment and Show Industry, for Architectural Lighting, for Automotive and Vehicle Lighting, for Medical Diagnostics and Therapeutic applications. Instead of or in addition to LEDs, other types of semiconductor light sources can be used, e.g. Laser with and without remote phosphor light conversion, Superluminescent LEDs, Organic Light Emitting Diodes (OLED) and the like. It should also be noted that the various light sources used in the described embodiments may differ in regard to their optical and photometric properties (like color temperature, lumen output, light distribution, etc.). Especially, the center LED may have different optical and photometric values than the circumferentially placed other LEDs.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An illumination unit for medical use, comprising:

a light source, and a first reflecting structure, wherein the light source has a connecting structure, and the light source is detachably installed on the first reflecting structure by means of the connecting structure, wherein the light source comprises a heat dissipation structure, and the connecting structure is formed on the heat dissipation structure and is in one piece with the heat dissipation structure, wherein the illumination unit further comprises a second reflecting structure and a shading structure, wherein at least part of light from a first part of light from the light source exits after being reflected by the second reflecting structure and a second part of light exiting from the light source is circumferentially blocked by the shading structure.

2. The illumination unit according to claim 1, wherein the first reflecting structure has a plug-in opening, and the light source is fixedly connected with the first reflecting structure in a manner of being inserted into the plug-in opening.

3. The illumination unit according to claim 1, wherein the illumination unit further comprises a lens, and the light from the first part of light, which is not reflected by the second reflecting structure, exits directly through the lens.

4. The illumination unit according to claim 3, wherein the light source comprises a plurality of light-emitting assemblies provided on the heat dissipation structure.

5. The illumination unit according to claim 4, wherein the second reflecting structure is rotationally symmetric, and viewed from a section through which an optical axis of the light source passes, the second reflecting structure has a reflective surface extending away from the direction of the optical axis.

6. The illumination unit according to claim 4, wherein the shading structure is configured in a sheet shape.

7. The illumination unit according to claim 6, wherein the shading structure is configured to block the light source in a circumferential direction of the light source, and the shading structure extends in a manner of approaching the optical axis of the light source.

8. The illumination unit according to claim 7, wherein the light-emitting assemblies comprise first light-emitting assemblies and second light-emitting assemblies, wherein the first light-emitting assemblies are provided in the center of the second reflecting structure, and the second light-emitting assemblies are arranged around the first light-emitting assemblies.

9. The illumination unit according to claim 6, wherein the shading structure extends in a manner of being parallel to the optical axis of the light source, and the light-emitting assemblies are separated from each other by the shading structure.

10. The illumination unit according to claim 9, wherein the illumination unit further comprises a plurality of sub lenses each being provided over respective light-emitting assembly.

11. The illumination unit according to claim 9, wherein the shading structure is formed by multiple intersected shading plates, wherein each two adjacent shading plates define a region for installation of at least one light-emitting assembly.

12. The illumination unit according to claim 4, wherein the light-emitting assemblies are configured as LEDs.

13. An illumination device for medical use, comprising:

an illumination unit, and a support, the illumination unit, comprising:

a light source, and a first reflecting structure, wherein the light source has a connecting structure, and the light source is detachably installed on the first reflecting structure by means of the connecting structure wherein the illumination unit is fixedly installed on the support by means of the connecting structure, wherein the light source comprises a heat dissipation structure, and the connecting structure is formed on the heat dissipation structure and is in one piece with the heat dissipation structure, wherein the illumination unit further comprises a second reflecting structure and a shading structure, wherein at least part of light from a first part of light from the light source exits after being reflected by the second reflecting structure and a second part of light exiting from the light source is circumferentially blocked by the shading structure.

* * * * *